United States Patent [19]

Pickens et al.

[11] 4,437,902

[45] Mar. 20, 1984

[54] BATCH-ANNEALED DUAL-PHASE STEEL

[75] Inventors: John W. Pickens, Strongsville; John K. Abraham, Broadview Heights; Raymond E. Mintus, Warren; Millicent H. Thomas, Broadview Heights, all of Ohio

[73] Assignee: Republic Steel Corporation, Cleveland, Ohio

[21] Appl. No.: 312,510

[22] Filed: Oct. 19, 1981

[51] Int. Cl.[3] ..... C21D 8/10

[52] U.S. Cl. ..... 148/12 F; 148/36; 148/134

[58] Field of Search ..... 148/12 R, 12 C, 12 D, 148/12 F, 12.1, 12.3, 12.4, 134, 36; 75/125, 123 K

[56] References Cited

U.S. PATENT DOCUMENTS

| | | | |
|---|---|---|---|
| 3,701,694 | 10/1972 | Osuka et al. | 148/12 |
| 3,827,924 | 8/1974 | Takechi et al. | 148/36 |
| 3,830,669 | 8/1974 | Matsuoka et al. | 148/12 |
| 4,047,979 | 9/1977 | Grange et al. | 148/12 F |
| 4,067,754 | 1/1978 | Elias et al. | 148/12 F |
| 4,410,369 | 10/1983 | Waid et al. | 148/12 F |

FOREIGN PATENT DOCUMENTS

| | | | |
|---|---|---|---|
| 55-79827 | 6/1980 | Japan | 148/12 F |
| 56-13459 | 2/1981 | Japan | 148/12 D |
| 56-13437 | 2/1981 | Japan | 148/12 D |
| 56-35722 | 4/1981 | Japan | 148/36 |
| W080/00456 | 3/1980 | PCT Int'l Appl. | 148/12 F |

OTHER PUBLICATIONS

W. S. Owen, "Can a Simple Heat Treatment Help Save Detroit?" (FIfth Harold Moore Lecture), *Metals Technology, Jan. 1980, pp. 1–13.*

T. Matsuoka et al., "Metallurgical Aspects in Cold Rolled High Strength Steels", *Metallurgical Transactions,* vol. 6A, Aug. 1975, pp. 1613–1622.

Bigsbee et al., "Structure–Processing and Structure--Property Relationships in Commercially Processed Dual–Phase Steels", *Structure and Property of Dual--Phase Steels,* AIME, 1979, pp. 304–306.

Crawley et al., "Processing, Properties and Modelling of Experimental Batch–Annealed Dual–Phase Steels", *Fundamentals of Dual–Phase Steels,* AIME, 1981, pp. 181–197.

*Primary Examiner*—Peter K. Skiff

*Attorney, Agent, or Firm*—Cooper, Dunham, Clark, Griffin & Moran

[57] ABSTRACT

Dual-phase steel, consisting essentially of a ferrite matrix containing islands of martensite, is produced by batch annealing of hot or cold rolled steel having carbon below 0.2% and manganese below 2% and at least critical contents of copper (0.4%) and nickel (0.6%), with heat to the alpha plus gamma region, followed by slow cooling. This procedure is effective and controllable, and yields a dual-phase steel product that has high tensile strength with excellent elongation properties and that develops good yield strength upon moderate deformation.

11 Claims, 1 Drawing Figure

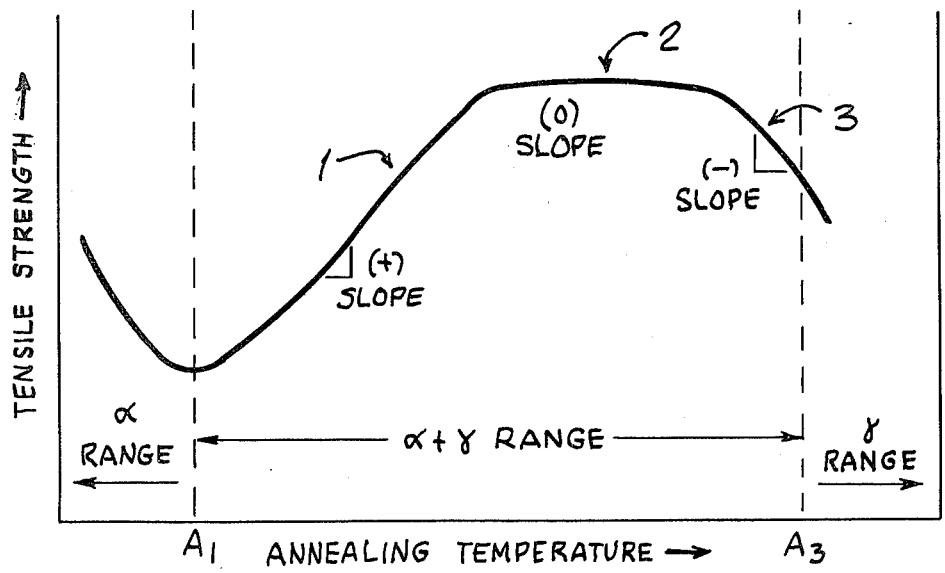
TENSILE STRENGTH
1
2
3
(0)
SLOPE
(+)
SLOPE
(−)
SLOPE
α
RANGE
α + γ RANGE
γ
RANGE
A1
ANNEALING TEMPERATURE
A3

BATCH-ANNEALED DUAL-PHASE STEEL

BACKGROUND OF THE INVENTION

This invention relates to dual-phase steel, and notably to procedure for making it, as well as to novel hot-rolled and cold-rolled products so manufactured, e.g. in the form of annealed strip. The invention also especially relates to steel tubing having a welded seam and made from skelp of annealed steel of dual-phase character. One particularly important aspect of the invention resides in procedure whereby cold-rolled, annealed skelp of dual-phase steel is produced and is converted to steel tubing, for instance tubing of such dimensional and manipulable nature that it can be rolled up into a coil for storage and transportation, as in the course of use or re-use for so-called down-well service in oil well operations. Another important aspect of the invention in the area of tubing is in respect to the use of hot-rolled, annealed skelp of dual-phase steel for making casing, such as oil well casing having outside diameter in the range of 6 to 15 inches or similar pipe from smaller to larger diameters.

Steel of a type that has come to be called dual-phase, usually produced in strip or equivalent form, has an internal structure characterized by islands, which are more or less discrete bodies (although sometimes interconnected) of primarily martensitic character, surrounded by a primarily ferritic matrix. This structure, thus consisting of a first or matrix phase which is essentially ferrite and which represents 70% or more by volume of the product, together with a second or distributed phase of contained bodies that constitute 10% or more of the product by volume and each have a major content of martensite, is understood to result from selected composition and processing and to afford certain advantageous mechanical properties now recognized as characterizing dual-phase steel. These properties in general involve superior formability and superior strength, especially relative to the strength:weight ratio of the steel and relative to its cost in the area of alloying elements; stated in another way, a prime advantage of dual-phase steels is in their ready formability (as to drawing, stretching, bending and the like), while exhibiting exceptional strength, in a manner not generally attained by presently conventional high-strength low-alloy (HSLA) steels.

In its as-produced form dual-phase steel is characterized by high ultimate tensile strength, as in the range of 70 ksi to 100 ksi or above, and relatively low initial yield strength, such that the ratio of yield to ultimate strength is of the order of not more than about 0.65 (preferably 0.6 or less). At the same time, the steel has high elongation (e.g. total elongation of 20% or up to 30% or so). The steel on deformation exhibits continuous yielding (homogeneous deformation rather than discontinuous) and rapid strain hardening which results in relatively high values of uniform elongation. This uniform elongation is preferably at least 15% or 18% or higher. The rate of strain hardening can advantageously be relatively great, so that on forming, as with moderate deformation, the yield strength rises quickly to relatively high values, as by increasing from 60 ksi to 80 ksi. These features, including the low initial yield strength and large, uniform elongation, make the steel relatively easy to form, with low forming loads, and less springback, while achieving advantageously high strength levels in the shaped products. As explained, the steel preferably has a very high rate of strain hardening, for instance so that the formed part can develop an 80 ksi flow stress after only 3 to 5% strain. The index of stretching formability, called "n", is relatively high for dual-phase steels, being greater than 0.2 in contrast to n-values of 0.1 to 0.13 ordinarily found for HSLA steels. It has been observed that n is not only a measure of the ability of the steel to resist necking, but if high, is also significant of more uniform redistribution of strain in a steel when thinning does occur.

An informative discussion of dual-phase steel and its recent state of development appears in W. S. Owen, Can a Simple Heat Treatment Help to Save Detroit? (Fifth Harold Moore Lecture), Metals Technology, Jan. 1980, pp. 1-13.

In general, dual-phase steels have been produced by employing a selected elemental composition or chemistry, and by following a selected processing technique, e.g. involving a so-called intercritical anneal or its equivalent, to achieve the desired structure and properties, in cold-rolled or hot-rolled products. One process has been to subject the hot-rolled or cold-rolled strip to continuous annealing, i.e. in a long, closed passage where the steel is heated rapidly to a temperature within the alpha plus gamma, or gamma region for a matter of minutes and then cooled relatively rapidly at rates corresponding to air cooling up to that of water quenching. Such air cooling can yield a cooling rate of around 20° F./second ($7.2\times10^4$ F/hour). This technique can be used to produce both hot and cold rolled thicknesses, but is usually limited to cold rolled thicknesses to about 0.060 inch or light hot bands, 0.065 to 0.150 inch, depending on furnace design.

By a carefully controlled hot rolling operation, dual-phase steel can be produced, but only in hot band gages. Thus the steel is rolled in a controlled manner such that the required amount of ferrite is formed during finish rolling, or on the run-out table before quenching (or at both localities, together), and thereafter the desired volume fraction of second phase constituent is achieved by water quenching the remaining austenite phase on the run-out table. Thus on water quenching the strip, the occurring bodies of austenite undergo transformation to martensite, with perhaps some bainite and some retained austenite. This transformation may occur during the quench or during cooling of the coil, depending on the alloy and on coiling temperature. This technique, limited to hot rolled product and requiring difficult control, is not commercially very attractive, while the continuous anneal requires costly equipment, not possessed by many steel producers.

Making dual-phase steel by a batch anneal, where coils of the original rolled strip (either H-R or C-R) are stacked in conventional annealing furnaces, and there subjected to heating and cooling in succession, would seem inherently convenient and economical, except that the heating and cooling cycle of a continuous anneal is a matter of minutes, presumably facilitating precise attainment of the desired transformations or conversions, whereas the cycle of a batch anneal will typically take two or more days. Indeed, reported experience of others in attempting to make dual-phase steel by batch annealing, even with inclusion of selected additions, such as small quantities of Cb and/or Ti, or V has not reached the desired results of both formability and strength, and such other workers have resorted to very high levels of Mn (e.g. 3%), which lead to steelmaking difficulties, in order to achieve the desired results. Experiments leading to the present invention revealed similar difficulty in attaining success by a batch anneal technique.

SUMMARY OF THE INVENTION

The invention is predicated on the discovery that upon selection of a particular composition of a melt of steel to be used, with contents at least of manganese, copper and nickel in critical ranges (preferably plus silicon and/or aluminum), a highly satisfactory dual-phase steel can be achieved by subjecting coils of either hot-rolled or cold-rolled strip to a batch anneal at a temperature appropriately controlled within the alpha plus gamma region, followed by cooling at the relatively slow rate of 25° to 100° F. per hour. The dual-phase steel thus produced, has desired characteristics of initial yield strength, ultimate tensile strength, elongation, and strain-hardening index, such as have been indicated hereinabove for products resulting from a continuous annealing technique.

As will be apparent from considerations discussed above, the minimum annealing temperature for the batch must be sufficiently above the $A_{c1}$ temperature that the amount of gamma iron or austenite formed is at least equal to (or often advantageously greater than) the final volume fraction of martensite, i.e. the volume of martensite islands, needed to achieve the desired high strength (UTS) in the annealed product. Then the cooling must produce, by transformation of austenite, at least the amount of martensite desired. Attainment of these relations is relatively easy with continuous annealing, where the temperature reached can be accurately controlled and where very rapid cooling can be used to insure effective transformation to martensite, without too much bainite and particularly without too much formation of pearlite instead of martensite. In the case of a batch anneal, however, the attained high temperature may not be controllable within better than 50° to 100° F., and the cooling is relatively very slow, hampering efforts to attain a dual-phase product by batch annealing.

In the present invention, these problems have been overcome, with a selected technique of the batch annealing operation, by special composition of the steel as indicated above. In a broad sense, the steel consists of (figures in weight percent, as elsewhere herein for elements): 0.02 to 0.2% carbon, 0.65 to 2.0% manganese, 0 to 0.75% silicon, 0.4 to 1.5% copper, 0.6 to 1.5% nickel, 0 to 1% molybdenum, 0 to 0.15% tungsten, 0 to 0.1% aluminum, balance iron and incidental elements. Advantageously, as explained in details hereinbelow, these elements can be selected within narrower ranges, or for example, considered individually, 0.03 to 0.15% carbon, 0.65 to 1.8% manganese, 0.4 to 1.2% copper, 0.6 to 1.2% nickel, and indeed with no molybdenum, which although very effective in increasing strength, may require the higher levels of carbon and is in any case relatively expensive, in fact now prohibitively so for many purposes.

In early experimental work relative to this invention, difficulty was encountered with non-uniformity of properties, such as UTS (ultimate tensile strength) and elongation, throughout individual coils. It was discovered, however, that these problems can be reduced or minimized by proper attention to the nature of the UTS-anneal temperature relationship for the selected alloy, with the accompanying implication that such relationship is governed to some extent by the composition. For example, if such relationship is expressed graphically, it is desirable that it show zero or little slope through a considerable part of the temperature region between $A_1$ and $A_3$; then unavoidable differences in temperature between and throughout the coils of strip in the annealing furnace can have little effect. It was noted, for example. that omission of molybdenum in steel containing not more than about 0.1% C desirably decreased the slope of the above curve toward zero over the range 1300°-1400° F. It is found that the alloys of the invention permit considerable variation in C content and in anneal temperature with little variation in tensile strength (UTS), a convenient attribute for full-scale mill production.

In a general sense, the present steels can be killed or not, as desired, and if killed may be so produced with usual agents such as aluminum (e.g. 0.02 to 0.1%) and silicon (up to 0.75%). Whether the dual-phase steel retains its continuous yielding behavior is somewhat dependent on its being aluminum killed. When the steel is not so killed (even though it may be killed with silicon), it will strain age much more readily, i.e. it will revert to a discontinuous yield characteristic with attendant increase in yield strength. Thus although aluminum killing retards the rate of appearance or return of this characteristic, killing with other deoxidizers does not. For many (but not necessarily all) of the products of the present invention, killing is desirable, especially with aluminum; prolongation of the continuous yielding behavior is definitely an advantage in applications subjected to stretch forming in particular, and to all formed parts in which final surface appearance is critical. On the other hand, even for A.K. (aluminum killed product), there remains an advantage of substantial increase of yield strength after any significant forming—i.e. for the useful strength of the formed part—and this phenomenon is nevertheless found to occur in A.K. steel of this invention. Industrial applications, however, are conceived for non-killed (e.g. rimmed) products, or ones otherwise killed, e.g. with silicon.

A special feature of the invention resides in the production of tubing, with major advantage in the equal applicability of the process to cold-rolled strip and to hot-rolled strip of any thickness, e.g. any thickness that can be coiled. In general, such production involves making a hot band with composition as described above. Then, for so-called down-well tubing for the oil industry, with outside diameter of the order of one inch, such band is cold rolled to make skelp of character suitable for the tubing; such skelp is coiled and given the batch anneal as has been explained, with slow cooling. Then the skelp is formed by bending to cylindrical contour, and electrically welded, with a special anneal of the weld zone, whereupon the tubing product is found to meet industry specification with high UTS and also high YS (yield strength).

Likewise, as illustrative of the versatility of the invention, the hot band of suitable gauge can be subjected to the intercritical batch anneal, with suitable cooling, and can be employed as skelp for products such as oil well casing, e.g. to have outside diameter up to about 15 inches, or indeed tubular products of larger diameters. Such skelp can be formed into cylindrical contour and welded, as by electrical resistance welding, with further anneal of the weld zone as and if necessary, to produce the desired casing. It is noted that hot-rolled and then annealed strip of the invention, such as the above casing skelp, tends to be higher in strength than cold-rolled and annealed product from hot band of the same hot-rolled structure, and that higher strength hot bands (e.g. as produced by lower coiling temperature) result in higher strength after intercritical annealing, whereas such variation in hot band strength has shown little effect of this sort in the resulting cold-rolled and batch-annealed strip.

As will be understood, the process involves producing and casting a melt of steel having the indicated composition, designed to have the needed austenite stability for transformation to achieve strength properties in the ultimate product. After hot rolling and coiling in essentially conventional manner, the hot band is either then batch annealed to make H-R strip, or cold rolled (e.g. 30 to 70% reduction) and thereafter batch annealed. The annealing cycle (e.g. two days or more) is performed on coils stacked in conventional annealing furnaces, heated to attain the desired temperature (between $Ac_1$ and $Ac_3$), most preferably between 1300° and 1400° F., or not over 1400°, and then cooled with usual flow of gas (air or other), at a rate of 25° to 100° F. per hour, e.g. 50° per hour. A special virtue of the invention is that in all cases the anneal may be done on so-called tight coils; although the process does not preclude open-coil annealing, which can advantageously have faster heating and cooling rates, few anneal shops have the facilities for open-coil annealing (where the strip coil turns are kept separated) and the use of tight coils is thus a notable feature of the invention.

Additional details and examples of the invention are set forth hereinbelow.

BRIEF DESCRIPTION OF THE DRAWINGS

The drawing is a graph showing schematically the nature of the relationship believed to exist, for the practice of the invention, between the attained tensile strength and the annealing temperature in the batch anneal operation.

DETAILED DESCRIPTION

In the practice of the invention, a melt of steel is made (and teemed into ingot molds), for example by using a process of the basic oxygen type, controlled to yield the desired carbon content, and having suitable concentration of the selected elements besides iron, each such element being incorporated in the furnace vessel, or added later (as in the ladle) as appropriate for the given element. The molds with the cast metal are processed in usual fashion, with regard for the killed nature of the steel if such is the case. Then the ingots are subjected to conventional hot deformation, completed with hot rolling to a gage suitable for coiling, e.g. not more than about 0.5 inch, the selected gage being one appropriate for use as hot-rolled steel, or for subsequent reduction by cold rolling. Finish temperatures of hot rolling, cooling rates (as on the run-out table) and coiling temperatures may be as known for low-carbon steels having not more than about 0.2% C and 1.75% Mn.

As a first example, ingots for a mill experiment were cast having the following average composition (balance iron and incidentals), in weight percent:

| C | Mn | Si | Cu | Ni | Mo | Al |
|---|---|---|---|---|---|---|
| 0.089 | 1.40 | 0.023 | 0.54 | 0.70 | 0.35 | 0.048 |

Contents of S and P were low, being about 0.012% each, and the heat also contained 0.02% chromium, but it appeared that Cr contributed little, if anything, to desired strength properties. Hot band coils (gage 0.09–0.16 in.) were produced from these ingots, and the strip from some of such coils, after the usual pickling, was cold rolled to a gage of about 0.044 to 0.076 inch. Both the hot band coils and the cold rolled coils (as tight coils) were then stacked in annealing furnaces, and subjected to anneal in the intercritical zone (alpha plus gamma), such that the temperature of the middle coil of each stack reached 1350° to 1375° F., heat being applied by the usual hot gas flow. (Hold time, after heat-up, was tried at about 12 hours and about 4 hours in additional laboratory experiments; at these temperatures slightly higher strength resulted from the longer time.) Then the coils were cooled by gas, e.g. air, at a rate of about 50° F. per hour. The total heat and cool cycle required at least two days. One cold-rolled coil, not among the above, was separately annealed to 1275°–1310° F., and similarly cooled; this strip showed very uniform properties throughout its length, but with considerably less formation of the stable second phase (gamma) constituent, and with lower tensile strength and some tendency to Luders (inhomogeneous) elongation with typical surface lines.

The properties of the hot and cold rolled products annealed at the higher temperature were as follows: Hot rolled strip: YS 45–73 ksi, UTS 85–112 ksi, total elongation 20–30%, uniform elongation 12–19%, YS/UTS ratio 0.44–0.68. Cold rolled strip (annealed ca. 1350° F.): YS 42–72 ksi, UTS 93–111 ksi, total elongation 19–25%, uniform elongation 12–18%, YS/UTS ratio 0.46–0.60.

These products showed considerable variation of properties and variation of structure, including the quantity of second phase constituent, between the inner and outer wraps of the coils, as well as between the coils. Nevertheless, the mechanical properties, as to formability and ultimate strength, while slightly inferior to tested samples of dual-phase steel (of different composition, e.g. lacking Ni and Cu) made by continuous anneal, was far superior to current high-strength, cold-rolled steel alternatives (lacking the dual-phase structure), and had greater flexibility of product character, i.e. did not suffer from the very restrictive gage and product capacity limits of the continuous-anneal type of dual-phase metal. The C-R strip annealed at lower temperature showed greater uniformity throughout, with higher total and uniform elongation, but lower YS and UTS (about 70 ksi).

A second example involved another heat of steel, processed as above to yield hot band having the following approximate percentage composition (plus iron and incidentals):

| C | Mn | Si | Cu | Ni | Al |
|---|---|---|---|---|---|
| 0.12 | 1.75 | 0.04 | 0.91 | 1.02 | 0.05 |

Again, cold rolled coils (0.057 in. gage) were produced and subjected to tight-coil batch anneal as before, at temperatures of 1300°–1400° F., with cooling at about 50° F. per hour. It is noted that this steel contained no molybdenum, and considerably higher contents of Mn, Cu and Ni, as well as carbon. These C-R coils, after the intercritical anneal, showed remarkable uniformity of properties along and between the coils, including UTS of about 85 ksi. The yield/ultimate ratio was about 0.62. Total elongation was about 21 to 26% and uniform elongation about 16 to 20%, with yield strength around 51 to 59 ksi. Evaluation of the results of this trial indicated that for annealing temperature as here, the range of 1300° to 1400° F., a stronger product, as with ultimate tensile strength up to 90 ksi, can be obtained with lower carbon content, such as the range of 0.06–0.09%.

Other experimentation, has indicated that in order to develop the desired dual-phase structure, with high tensile strength and large values of elongation, in a batch annealing operation which is handicapped by long heat-up time and very slow cooling, the above alloying elements are required, including Mn, Ni and Cu. Although manganese levels up to 2.5% are conceivably useful, a practical maximum is 1.8% in steelmaking shops using fireclay refractories; useful batch annealed dual-phase products can be made with Mn as low as 0.65%. Nickel is an important constituent, for strength and for promoting austenite stability, in the second phase, to avoid excessive formation of pearlite (or bainite) on cooling rather than the desired martensite; in general, for strength with lower Mn content, Ni must be increased by about equal percentage. Copper contributes strength like Mn or Ni, especially as included up to 0.5% and moderately in the further range to 1.0% and above, with less effect in such higher range for steel to have tensile strength above 85 ksi.

It appears that copper above 0.75% may retard ferrite recrystallization kinetics, leaving non-recrystallized ferrite after annealing and thus affecting the desired ferrite structure of the first or matrix phase of the product and impairing the desired ductility. Nevertheless, quite successful products have been made with Cu to 1.0%; in such case it is believed that change in the hot mill product can counteract ductility difficulty, as by using a lower coiling temperature off the hot mill. For example, where the hot mill finish temperature was around 1600° F. (e.g. 1560°–1660° F.) and coiling at 1120°–1310° F. in the above first and second examples, improved results (including higher strength) in the second example would be expected with coiling at about 1000° to 1100° F.

Additions of silicon (which is a ferrite stabilizer) have shown that up to 0.5% or above, tensile strength can increase by about 1 ksi or more for every 0.1% Si. This element can also be used for killing, although without the special advantage of Al mentioned above, in range of 0.3 to 0.7% with strength enhancement at the same time.

Studies of effects of starting structure, i.e. of the hot band, on the properties of the product after batch intercritical annealing, revealed the following as to AK steel having 0.06–0.08% C, 1.75% Mn, 0.95% Ni, 0.95% Cu: Hot-rolled and annealed strip tended to be higher in strength than cold-rolled and annealed strip from the same hot-rolled starting structure. Hot-rolled starting structure had a significant effect on hot-rolled and annealed properties, e.g. higher strength hot bands (due to lower coiling temperature) provided higher strength after the anneal. There was relatively small effect on the cold-rolled and annealed strip occasioned by variations in the hot-rolled starting structure or by different extents of cold reduction (30% to 70%).

Some other specific compositions noted as particularly useful for batch-annealed dual-phase products were as follows:

| | % | | | | |
|---|---|---|---|---|---|
| | C | Mn | Ni | Cu | Mo |
| Alloy A | 0.045–0.08 | 1.75 | 1.10 | 0.5 | 0 |
| Alloy B | " | " | 0.95 | 0.95 | 0 |
| Alloy C | " | " | 0.90 | 0.5 | 0.1 |

Alloy A is conceived useful as flat cold-rolled product for automotive purposes, with UTS of 90 ksi; alloy B (cold-rolled) for so-called down-well tubing, with UTS of 85 ksi; and alloy C, also for high strength (90 ksi) use, although it tends to involve some difficulty in getting uniform properties from end to end of a coil or between coils. Molybdenum (e.g. 0.1 to 0.5%, or up to 1.0%) is extremely effective in increasing strength, as is tungsten (e.g. 0.02 to 0.07%, or up to 0.15%), but use of these elements is preferably coupled with relatively high carbon levels and/or fairly high levels of Mn and/or Ni, which are austenite stabilizers, in order to attain peak strength uniformly within the practical tight coil annealing temperature limit (upper) of about 1400° F.

The drawing shows a schematic graph of the relation between ultimate tensile strength (UTS) of the batch-annealed product and temperatures of annealing. To attain the desired volume of austenite bodies to be transformed (as much as possible) to martensite on cooling, the temperature must be within the critical values $A_1$ and $A_3$ of the alloy (for the alpha plus gamma range); the minimum temperature must be sufficiently above the $A_1$ temperature to have the amount of gamma (austenite) formed at least equal to the final volume of martensite needed (e.g. 10% or more) for the desired strength level. As shown, the curve of strength rises with a positive slope [region 1], then traverses a flat (0 slope) region [2]and descends through a negative slope [region 3]. It is most desirable, in the batch anneal, to aim the temperature within the zero-slope region and to keep the range of obtained coil temperatures within such region, because gradients of the order of 50° to 100° F. may exist within the tight coils in the annealing furnace. At the same time, use of too high an annealing temperature, creating an unduly large volume of austenite, can result in formation of too large a volume of pearlite instead of martensite on cooling at the slow rates here contemplated (e.g. 50° F./hour, or within 25°–100° F./ hour), with loss of tensile strength. In tight-coil batch annealing, moreover, a practical upper limit is about 1400° F.; higher temperatures tend to cause "stickers", when adjacent coil wraps begin to weld together.

It appears that the presently preferred Mn-Ni-Cu alloys described herein show a very useful flat region [2]of the UTS-anneal temperature curve (below 1400° F.), e.g. at 1310°–1370° F., allowing considerable latitude as to the actual temperatures reached in the heated coils. It is also observed that austenite stabilizers, such as Mn, Ni, Cu tend to move the flat region to the left, while ferrite stabilizers (e.g. silicon and tungsten) move it to the right. The variation of UTS in alloys containing molybdenum has been interpreted as indicating too short a flat region below 1400° F., correctible by using a higher carbon level, and/or higher Mn, Ni, Cu levels (all austenite stabilizers). The austenite stabilizers, of course, are understood to function usefully by inhibiting transformation of austenite to pearlite or bainite during the slow cooling, so that martensite formation is maximized, and by increasing austenite formation at lower annealing temperatures.

In general, useful temperatures for the tight-coil batch anneal lie within 1300°-1400° F. (or above 1310°), very advantageously 1340°-1370° F.; selection of optimum temperature can be readily achieved, if necessary, with laboratory melts and tests of the specific alloy chosen. Moreover, in practice, the anneal can be performed to reach a desired "cold-spot" temperature (minimum temperature within the coldest coil), as for example of around 1330°-1350° F. for an aim of 1340° F. Heating rates can be as low as 25° to 100° F./hour, and it is presently believed that a minimum time at temperature, say at least two hours and preferably at least four hours, is highly desirable, especially as there may be some useful mass transfer, or diffusion, of alloying elements (Mn, Ni, Cu) to the austenite formed.

An important aspect of the invention resides in the production of tubing, including the production of skelp therefor that is of the batch-annealed, dual-phase nature described above. A first example of such tubing is the so-called down-well, coiled tubing which is employed in the operation or servicing of oil wells, usually having an outside diameter of about one inch. Present properties desired for such tubing (for so-called sour-well use) include high yield strength approaching 80 ksi, UTS of at least 85 ksi (preferably 90 ksi minimum) and maximum hardness (macro-hardness) of $R_c22$. A first mill trial of making such tubing involved cold-rolled strip of the first batch-annealed dual-phase example hereinabove, having a composition with Mn, Ni, Cu and Mo, and slit into suitable widths. The so-available skelp was continuously formed into tubing, with appropriate forming rolls such that the edges were butted together. The edges were high frequency heated and forced together with some upset, to perform the welding, and the outer upset flash was machined off. The tubing was run under a seam annealer and cooled along about 60 feet of run-out table, followed by coiling as is conventional, i.e. into 6 foot diameter coils. It may be noted that the skelp had excellent ductility, embracing a total elongation of 18.5 to 24.5% for an ultimate tensile range of 92 to 108 ksi. More significantly, the tubing had yield strength of 89 to 97 ksi and UTS of 106 to 117 ksi, indicating that the moderate deformation of forming the tubing had involved sufficient strain to increase the yield strength from a range of 50 to 62 ksi by about 35 to 38 ksi, the tensile being also increased by 12 to 15 ksi. The hardness was somewhat higher than the target maximum of $R_c22$. It was concluded that the considerable variation of properties over the coil run could be avoided in this Mo-containing alloy by using higher carbon levels and/or higher Mn. This can result in high-strength tubing of at least 90-100 ksi minimum YS, and/or in addition, a 75-80 ksi minimum YS tube which avoids excess hardness in weld and base metal while maintaining uniform properties is possible in Mo-bearing tube by using higher C and and/or higher Mn and/or lower Mo with seam anneal at a lower-than-conventional temperature.

In another mill trial of producing down-well tubing, of like dimension and by like forming and welding, the skelp had composition (percent) of

| C | Mn | Si | Cu | Ni | Al |
|---|---|---|---|---|---|
| 0.13 | 1.79 | 0.035 | 0.91 | 1.02 | 0.044 |

balance iron and incidentals. This steel was hot rolled, and the hot band cold rolled to suitable skelp thickness, followed by batch anneal to dual phase condition of skelp, and forming and welding into tubing as described above. The annealed skelp had very uniform properties throughout its length, with average values as follows: tensile 85.2 ksi, yield strength 54.0 ksi, total elongation 23.6% and uniform elongation 17.7%. The produced tubing showed yield strength substantially consistently above 80 ksi, UTS about 90 ksi or higher (mean of 95) and total elongation 12-25% (mean of 15.3%). Hardness, especially in the weld zone, was somewhat above $R_c22$; although the tubing was very suitable for so-called sweet-well use (no hydrogen sulfide), control of seam anneal (with lower hardness) and reduction of Ni to no more than 1.0% are indicated to provide utility for sour-well (presence of $H_2S$) service. It is likewise indicated that lowering of copper, e.g. to 0.6%, with some lowering of carbon level (0.05 to 0.08%) will avoid the effect of copper in reducing ductilty by retarding ferrite recrystallization, while maintaining desired strength levels. It appears that the seam anneal should be kept in the same intercritical range (below 1400° F.) as the batch anneal, to reduce hardness below $R_c22$.

It will be understood that representative wall thicknesses (and thus of skelp) for 1-inch coiled tubing are about 0.043, 0.065, 0.085 or 0.109 inch. Trials have been successfully performed, e.g. as above, producing tubing from 0.065 and 0.085 inch, cold-rolled, batch-annealed, dual-phase skelp, but it is noted that the thicker gages of this group (e.g. 0.085 and greater) could equally be of hot-rolled, batch-annealed, dual-phase skelp.

Although non-killed (e.g. rimmed) steel is contemplated by the invention if desired, all of the examples above were in fact aluminum killed. As will be appreciated, other additions or treatments may be employed for known effects; for instance, rare earth metals can be added in the usual very small amount if desired for correcting directionality (relative to rolling direction) of mechanical properties.

Another aspect of the invention resides in ERW (electrical resistance welded) pipe with O.D. in the range from well below 6 to well above 16 inches (or indeed of any size), made from skelp of hot-rolled strip of batch-annealed, dual-phase nature having a thickness, for example, of about 0.25 to 0.5 inch, especially oil well casing with O.D. of about 6-⅝ to 13-⅜ inches. An important feature of the production of batch-annealed, dual-phase steel according to this invention is that the steel is eminently useful, not only in various cold-rolled thicknesses but alternatively over a very considerable range of hot-rolled gages. In making the oil well casing type of product, the hot-rolled skelp has an alloying content, preferably, of 1.7 to 1.8% Mn, 0.9 to 1.05% Ni, 0.5 to 1.0% Cu, without Mo or W and with carbon below 0.1% for casing with UTS around 90 ksi, depending on final casing dimensions (degree of forming). Higher strength casing may utilize Mo and/or W to great advantage in hot-rolled, batch annealed skelp in which event lower Mn and/or Ni may be utilized depending on final casing dimensions and final intended strength level. As further example of the practice of the invention, casing has been successfully made from hot-rolled, batch annealed skelp containing about 0.07% C, 1.2% Mn, 0.70-0.80% Ni, 0.5-0.6% Cu and 0.3% Mo. This casing (8-⅝ inch O.D. and 0.264 inch wall) had 76-86 ksi YS and 91-99 ksi UTS. It is indicated that by raising the manganese to 1.4 to 1.5%, the finished casing can achieve minima of 80 ksi YS and 100 ksi UTS. In all cases, the batch anneal is performed as above, and the casing is made by forming to cylindrical shape, and subjecting the cleft to electrical resistance welding in conventional manner. The final product has high yield strength, high ultimate tensile, and sufficient ductility for its purpose, all achieved without any subsequent heat treatment such as is conventional for past manufacture of this kind of tubing or pipe.

It is to be understood that the invention is not limited to the specific embodiments and steps herein described but may be carried out in other ways without departure from its spirit.

We claim:

1. A method of making a dual-phase rolled steel product which has ultimate tensile strength of at least 80 ksi, yield/ultimate tensile ratio not higher than about 0.65 and at least about 18% total elongation, comprising: establishing steel in ingot form having a composition consisting essentially of 0.03 to 0.2% carbon, 0.65 to 2.0% manganese, 0 to 0.75% silicon, 0.4 to 1.5% copper, 0.6 to 1.5% nickel, 0 to 1% molybdenum, 0 to 0.15% tungsten, 0 to 0.1% aluminum, balance iron and incidental elements, subjecting said steel to rolling, including hot rolling, to convert said steel to tightly coiled, rolled strip, batch annealing said coiled strip in an enclosed region, by heating said coiled strip to within an alpha plus gamma region of said steel, at a temperature not higher than about 1400° F., thereafter cooling the coiled strip within the range of about 25° to 100° F. per hour, and thereby producing the above-described rolled steel product, which comprises a matrix phase that is chiefly ferrite, and bodies of a second phase that are chiefly martensite distributed in said matrix.

2. A method as defined in claim 1, in which the steel composition contains 0.03 to 0.12% C, 0.65 to 1.8% Mn, 0.4 to 1.2% Cu, 0.6 to 1.2% Ni, 0 Mo, and 0 W, said dual-phase product having UTS of at least 85 ksi.

3. A method as defined in claim 1 or claim 2, in which the rolling operation includes cold rolling after the aforesaid hot rolling so that the coiled strip subjected to batch annealing is cold rolled strip.

4. A method as defined in claim 1 or claim 2, in which the rolling operation consists of hot rolling, so that the coiled strip subjected to batch annealing is strip which is in as-hot-rolled condition.

5. A method as defined in claim 1, in which the steel composition contains 0.03 to 0.1% C, 1.0 to 1.8% Mn, 0.4 to 1.2% Cu, 0.9 to 1.2% Ni, 0 Mo, and 0 W, said dual-phase product being aluminum-killed and having UTS of at least 85 ksi.

6. A method of making tubing, including performing the method defined in claim 1, in which: the rolling operation includes cold rolling after the aforesaid hot rolling so that the coiled strip subjected to batch annealing is cold rolled strip; and the batch-annealed cold rolled strip is constituted as skelp, said skelp being formed into cylindrical shape with butted edges, and said tubing manufacture being completed by electrically welding said edges.

7. A method of making tubing as defined in claim 6, in which the steel composition is aluminum-killed and contains 0.03 to 0.1% C, 1.7 to 1.8% Mn, 0.4 to 1.2% Cu, 0.9 to 1.2% Ni, 0 Mo, and 0 W, said tubing having UTS of at least 85 ksi, and the welding of said edges being effected by high frequency welding.

8. A method of making heavy-walled tubing of outside diameter greater than one inch, including performing the method defined in claim 1, in which: the rolling operation is completed with hot rolling, the coiled strip subjected to batch annealing being hot-rolled strip, and the batch-annealed, hot-rolled strip being constituted as skelp, said skelp being formed into cylindrical shape with butted edges, and said tubing manufacture being completed by electrically welding said edges.

9. A method of making tubing as defined in claim 8, in which the steel composition is aluminum-killed and contains 0.03 to 0.12% C, 1.7 to 2.0% Mn, 0.4 to 1.2% Cu, 0.7 to 1.2% Ni, 0 Mo and 0 W, said tubing having UTS of at least 85 ksi, and the electrical welding of the skelp edges being effected by electrical resistance welding.

10. A method of making tubing as defined in claim 8, in which the steel composition contains 0.03 to 0.12% C, 1.0 to 1.8% Mn, 0.4 to 1.2% Cu, 0.6 to 1.2% Ni and 0.1 to 0.5% Mo, said tubing having UTS of at least 90 ksi, and the electrical welding of the skelp edges being effected by electrical resistance welding.

11. A method as defined in claim 1, in which the composition of the steel is such and the annealing and cooling of the coiled strip are so performed that the said matrix phase constitutes at least about 70% by volume of the rolled steel product and the said second phase constitutes at least about 10% by volume of said product.

* * * * *